United States Patent [19]

Turano et al.

[11] Patent Number: 4,696,312

[45] Date of Patent: Sep. 29, 1987

[54] METHOD AND APPARATUS FOR PRODUCING CIGARETTE FILLER

[75] Inventors: Louis R. Turano, Colonial Heights; William T. Callaham; John F. Sherwood, both of Richmond; Richard E. Thatcher, Chester, all of Va.

[73] Assignee: Philip Morris Incorporated, New York, N.Y.

[21] Appl. No.: 839,922

[22] Filed: Mar. 17, 1986

[51] Int. Cl.[4] ..... A24B 3/07

[52] U.S. Cl. ..... 131/109.1; 131/313; 131/318; 131/322

[58] Field of Search ..... 131/109.1, 311, 312, 131/313, 317, 320, 318, 322

[56] References Cited

U.S. PATENT DOCUMENTS

| | | |
|---|---|---|
| 1,668,610 | 5/1928 | Semenov . |
| 3,004,539 | 10/1961 | Molins . |
| 3,128,775 | 4/1964 | Eissmann . |
| 3,219,042 | 11/1965 | Molins . |
| 3,232,297 | 2/1966 | Gamberini . |
| 3,262,457 | 7/1966 | Gamberini . |
| 4,031,903 | 6/1977 | Brackmann et al. . |
| 4,036,239 | 7/1977 | Preston et al. . |
| 4,214,595 | 7/1980 | Labbe et al. . |
| 4,233,996 | 11/1980 | Brackmann et al. . |
| 4,640,300 | 2/1987 | Coleman . |

FOREIGN PATENT DOCUMENTS

| | | |
|---|---|---|
| 2102272 | 2/1983 | United Kingdom . |

*Primary Examiner*—V. Millin

*Attorney, Agent, or Firm*—Jeffrey H. Ingerman

[57] ABSTRACT

A method and apparatus for producing tobacco filler by cutting whole tobacco leaves, including stems, is provided. The leaves, with stems in, are cut to produce strands of lamina and strands of stem and lamina. The strands are carded to disentangle them and then put through a separator to separate the strands of lamina, for use as filler, from strands of stem and lamina. The strands of stem and lamina can be carded again to disentangle may remaining strands of lamina that there may be, and the strands can then be passed through another separator. The process can be repeated several times if necessary.

10 Claims, 4 Drawing Figures

METHOD AND APPARATUS FOR PRODUCING CIGARETTE FILLER

BACKGROUND OF THE INVENTION

This invention relates generally to the field of tobacco processing and more particularly to cutting whole tobacco leaves for use in cigarettes.

The tobacco that is used in cigarettes is for the most part the lamina portion of the tobacco leaf. This is the thin, flexible portion of the leaf. The stem portion of the tobacco leaf is generally unsuitable for direct use as cigarette filler for several reasons, one of which is that the tobacco stem is more like wood than leaf and will punch holes in the wrapper of the cigarette. Therefore, the stem must be separated from the lamina prior to processing the lamina for use as filler.

The most common method of separating the tobacco lamina from the stem is threshing. In the threshing process, the tobacco leaf is beaten with a bar in order to knock the lamina off the stem. The lighter lamina is separated from the resulting mixture of stem and lamina (e.g., pneumatically) and the stem passes through additional threshing stages to remove more lamina until the stem is essentially free of all lamina.

A drawback of this method of processing whole tobacco leaf is that the lamina, the most valuable portion of the tobacco leaf, is damaged by threshing. Also, a portion of the lamina may be broken down into such small particles that it is unusable or requires significant additional processing prior to use. It is desirable that as little of the tobacco lamina be lost as possible. Additionally, certain characteristics of cigarettes are improved when longer pieces of lamina, or "longs", are included in the filler of the cigarette.

Prior attempts to avoid the threshing step in tobacco processing have met with limited success. One attempt, shown in U.S. Pat. No. 3,219,042, cut the whole tobacco leaf and pneumatically separated the stem from the leaf. The stem was then further processed and added back to the lamina. However, the long strands of lamina and stem produced by cutting the whole leaf became entangled and pneumatic separation of the cut tobacco leaf could not remove all of the stem portion without additional processing.

SUMMARY OF THE INVENTION

It is an object of the invention to provide a method of processing whole leaf tobacco for use in cigarettes without threshing the tobacco.

It is also an object of the invention to provide a method of separating strands comprising lamina and stem and strands consisting of lamina from cut whole leaf tobacco.

It is a further object of the invention to provide a method of producing tobacco filler with a greater fraction of longs than conventional filler.

According to the present invention, the foregoing and other objects are obtained by cutting whole leaf tobacco to substantially the same width as cigarette filler to produce strands of tobacco consisting of lamina and strands of tobacco comprising lamina and stem. The cut whole leaf is carded to disentangle the strands. The strands of tobacco consisting of lamina are then separated from the strands comprising lamina and stem.

BRIEF DESCRIPTION OF THE DRAWINGS

The above and other objects and advantages of the invention will be apparent upon consideration of the following detailed description, taken in conjunction with the accompanying drawings, in which like reference characters represent like parts throughout, and in which.

DETAILED DESCRIPTION OF THE INVENTION

Figure 1:
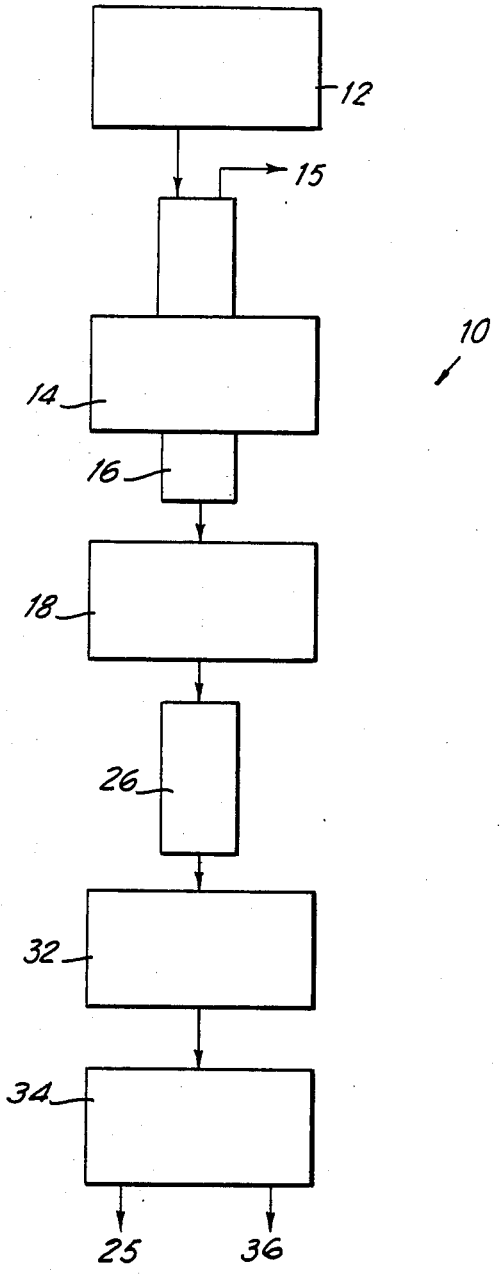
FIG. 1 is a schematic flow diagram of a tobacco processing operation in accordance with the present invention.

FIG. 1 shows a preferred embodiment 10 of a processing line for processing whole tobacco leaves into filler which is relatively free of stem and suitable for use in cigarettes. The whole tobacco leaves enter processing line 10 at leaf feeder 12. Leaf feeder 12 can be a pin feeder such as is well known in the art. The whole tobacco leaves have been preconditioned to a moisture content of approximately 18–32% so that they are less susceptible to breakage during processing. The optimum moisture content in the case of flue-cured tobacco is approximately 22–24%. Casing, or flavoring, may also have been applied to the leaves, both to adjust the taste of the final cigarette filler, and to precondition the leaves for cutting.

Leaf feeder 12 feeds into conveyor 16. Metal detector 14, located above conveyor 16, checks for the presence of metallic objects in the whole leaf tobacco. On detection of metallic objects by metal detector 14, the direction of conveyor 16 is automatically momentarily reversed and tobacco containing metal is dumped at 15 for separate processing.

Conveyor 16 feeds cutter 18. Cutter 18 cuts the whole leaf tobacco to a width suitable for use directly in the manufacture of cigarettes. The width can range from about 25 to about 100 cuts per inch. However, the preferred width is 30 cuts per inch.

Bulking conveyor 26 is used to accumulate the strands of cut leaf, because the portion of the process described above runs at a higher mass flow rate—approximately 2500 pounds per hour—than the remaining portion of the process, which runs at from about 100 to about 1750 pounds per hour.

Bulking conveyor 26 feeds carding feeder 32. Carding feeder 32, shown more clearly in FIG. 2, has a feed belt 57 for feeding tobacco to a spiked apron 58. Combing roller 60, which runs in a direction opposite to spiked apron 58 at their point of contact, aligns the strands on spiked apron 58 and initially disentangles them. Combing roller 60 also rejects excess cut leaf back to feed belt 57, to maintain a uniform feed of cut leaf on spiked apron 58. Combing roller 60 rotates at a linear velocity of 2 to 5 times faster than the linear velocity of spiked apron 58 at their point of contact. Preferably, combing roller 60 is run at its highest available speed, which is approximately 250 r.p.m., to maximize the performance of separator 34. Air knife 62 further disentangles the strands and removes them from spiked apron 58.

Air knife 62 is a conventional strip air mover such as that sold by Nortel Machinery, Inc. of Buffalo, N.Y. under Model No. SE600. Air knife 62 is an elongated aluminum block having a slit along its length. Air at 90 psig is forced out of the slit and flows along the specially shaped surface of the block in accordance with the Coanda effect to provide a high-volume curtain of air. Deflector 63 further controls the air flow in accordance with the Coanda effect, and is shaped so that the air flow strips strands from spiked apron 58 and blows them, without re-entangling, to separator 34, the intake of which is placed below air knife 62.

Any type of separator may be used. However, in the preferred embodiment a vibrating trough separator, such as described in copending, commonly-assigned U.S. patent application Ser. No. 569,013, filed Jan. 6, 1984, is used. Briefly, the vibrating trough separator operates by using a vibrating bed and air to fluidize the cut leaf wherein the lighter fractions such as lamina are drawn off at 25 by the air stream which is fluidizing the cut leaf, and the heavier fractions of strands including cut stem and strands including cut stem entangled with strands consisting of lamina are removed at 36.

The material removed at 36 may be returned for additional passes through carding feeder 32 and separator 34 for further disentanglement and separation. Preferably, the material is returned four times for a total five passes.

Figure 2:
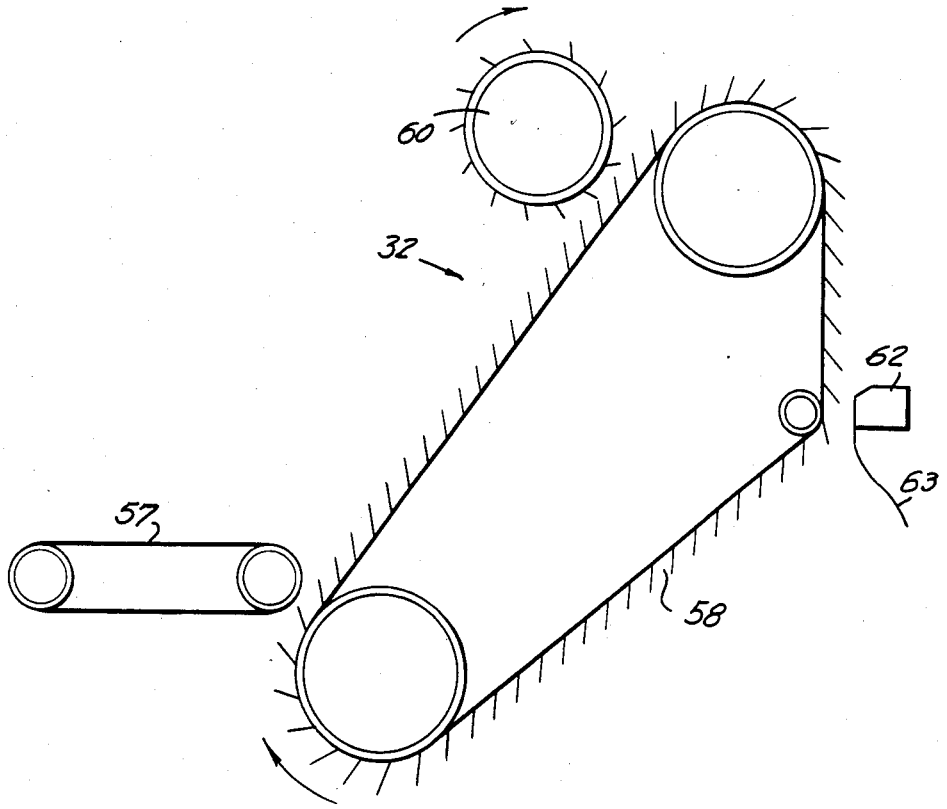
FIG. 2 is a transverse, vertical cross-sectional view of a carding feeder as used in the present invention.
Figure 3:
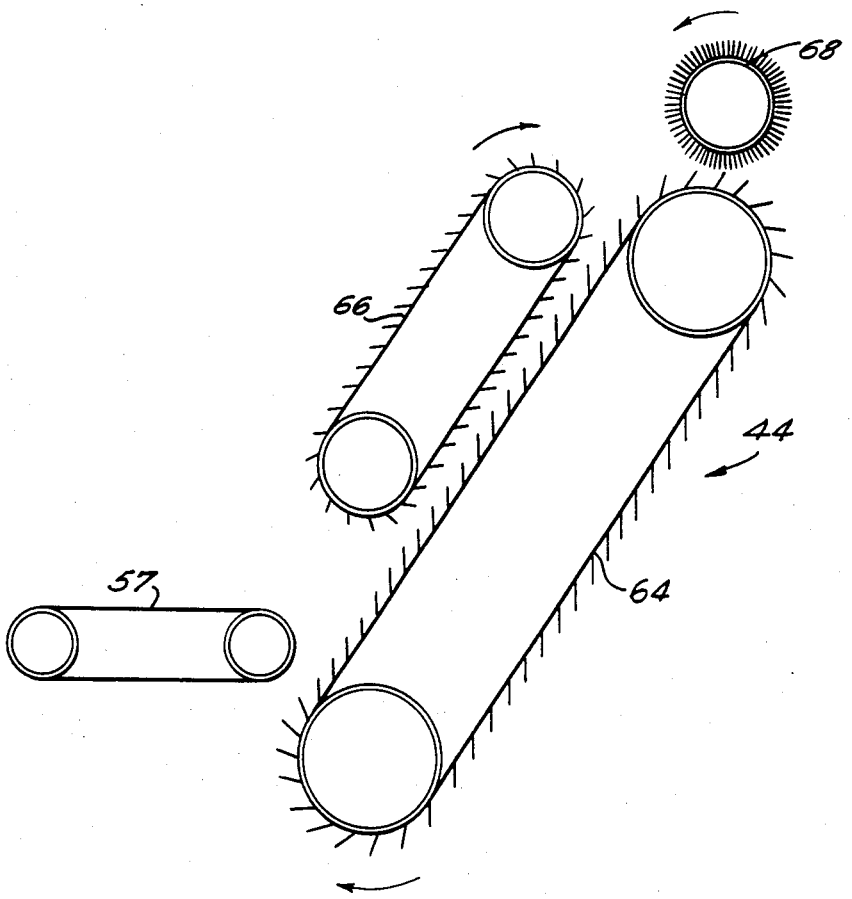
FIG. 3 is a transverse, vertical cross-sectional view of an alternative carding feeder as used in the present invention.

An alternative embodiment 44 of a carding feeder according to the invention is shown in more detail in FIG. 3. Cut leaf fed to carding feeder 44 on feed belt 57 is picked up on spiked apron 64. A combing apron 66 is provided and it rotates so that it is moving in the opposite direction of spiked apron 64 at their point of contact. Combing apron 66 serves to reject excess cut leaf back to feed belt 57 and to align the strands of cut leaf thereby initially disentangling the strands consisting of lamina and the strands including cut stem. Using a combing apron 66 in place of combing roll 60 as shown in FIG. 2 allows the combing apron to run at a slower velocity relative to the spiked apron. While a combing roller should be run at its highest available velocity to maximize separator performance, the combing apron can be run at a slower relative velocity to the spiked apron 64, decreasing tobacco degradation without decreasing separator performance, or it can be run at the same relative velocity as a combing roller, further increasing separator performance. The velocity of combing apron 66 may be 2 to 5 times faster than the linear velocity of spiked apron 64, which moves at from about 10 feet per minute to about 400 feet per minute. However, its velocity is preferably only approximately 2 to 3 times faster than that of the spiked apron.

The length of the combing apron 66 in contact with spiked apron 64 may vary. However, the greater the length of contact, the more efficient the combing action at slower relative speeds. In the embodiment shown, the combing apron 66 is in contact with spiked apron 64 over approximately one-third of its length.

A fancy roller, or stripper roller, 68 rotates such that it is moving in a direction parallel to spiked apron 64 at their point of contact, and picks strands of cut leaf off spiked apron 64, further dissentangling them.

The linear velocity of fancy roller 68 is approximately 2 to 5 times faster than the linear velocity of spiked apron 64 at their point of contact. Leaving carding feeder 44, strands including cut stem and strands consisting of lamina are disentangled. The strands are accelerated horizontally from the nip between spiked apron 64 and fancy roller 68 into the intake of separator 34 which is aligned horizontally with the nip.

Figure 4:
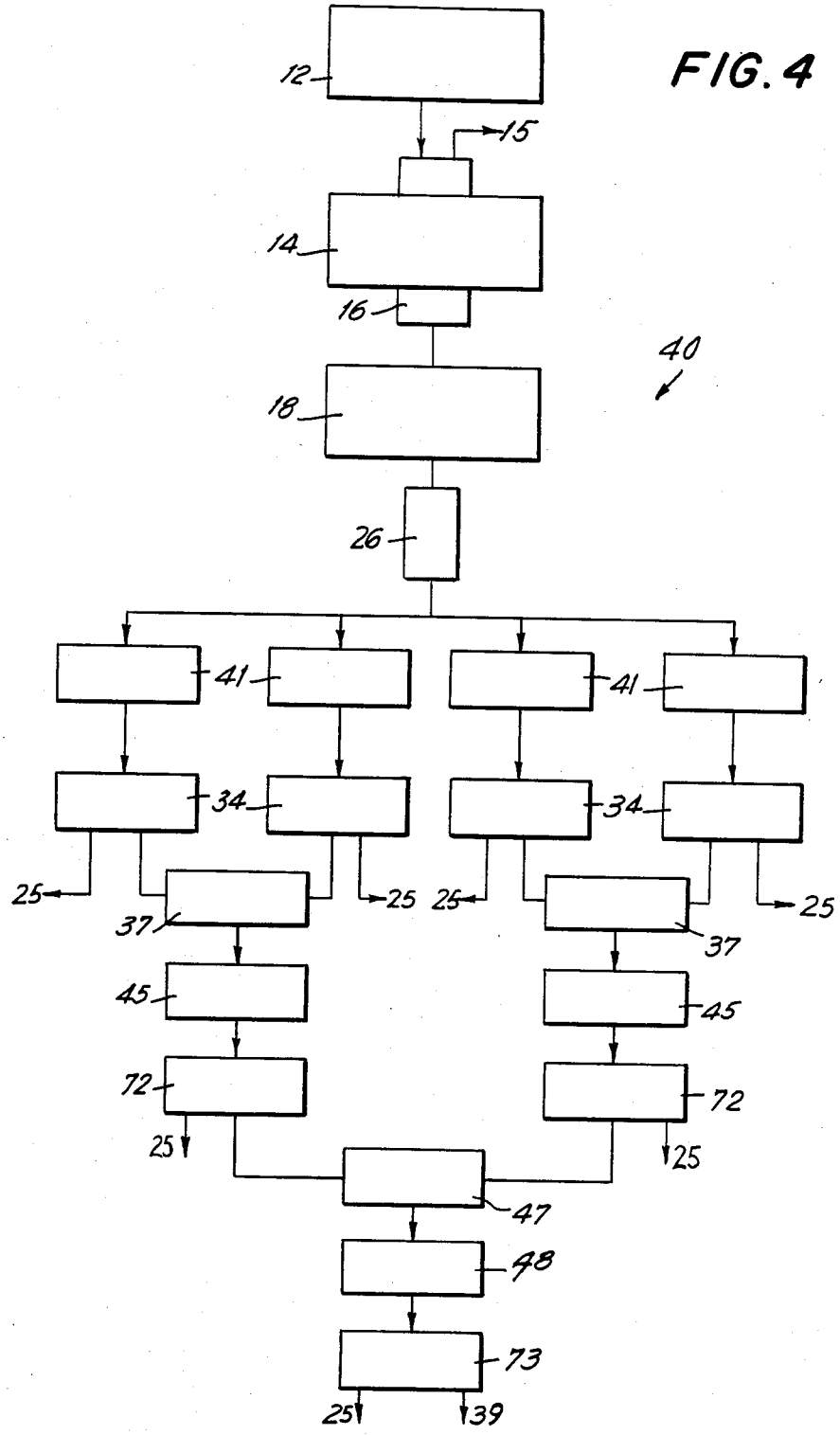
FIG. 4 is schematic flow diagram of an alternate embodiment of a tobacco processing operation in accordance with the present invention.

FIG. 4 shows an alternative embodiment 40 of a processing line according to the invention. Leaf feeder 12, metal detector 14, conveyor 16 and cutter 18 are as described above.

After being cut by cutter 18, the cut whole leaf tobacco is transported by high speed conveyor 20 directly to several identical carding feeders 41, which can be of either of the types shown in FIGS. 2 and 3. The number of carding feeders at this point may be varied according to the relative capacities of conveyor 20 and carding feeders 41. Carding feeders 41 disentangle the cut whole leaf tobacco as described above.

Carding feeders 41 feed an identical number of vibrating trough separators 34 which remove tobacco filler at 25.

The remaining cut tobacco leaf containing stems is accumulated at 37 and fed to second stage carding feeders 45. The number of second stage carding feeders may vary depending on the relative capacity of carding feeders 45 and separators 34.

Second stage carding feeders 45 feed cut whole leaf to other vibrating trough separators 72. Filler is removed at 25 and the remaining strands including stems are accumulated at 47 and fed to third stage carding feeders 48. Again, the number of third stage carding feeders 48 will vary depending on the relative capacity of carding feeders 48 and separators 72. Third stage carding feeders 48 feed cut whole leaf to additional vibrating trough separators 73. Filler is removed at and the remaining strands including stems are removed at 39. The provision of parallel and additional stages of equipment in line 40 allows line 40 to operate in a continuous mode rather than in a batch mode as does line 10.

Up to two additional stages (not shown) can be provided in processing line 40, for a total of five stages as in processing line 10. However, it is possible that processing line 40 may only need three stages, as shown, to accomplish what line 10 accomplishes in five stages. Because the strands are not re-bulked after every stage of line 40, as they are in line 10, they do not become re-entangled as they do in line 10. Therefore, they may not require as many processing stages.

In either line, it is estimated that after the first separation, up to 50 percent of the weight of tobacco leaf being processed can be removed as filler and that, after the second separation, an additional 20 percent of the original tobacco weight can be removed. The filler, which exits the line at a moisture of approximately 18–20% is then blended with other types of tobaccos as it normally would be for use in cigarettes, and the resulting blend is dried to cigarette making moisture levels.

Filler produced by the conventional threshing process contains approximately 44% "longs" (defined as 6 mesh or larger) and approximately 71% longs and "mediums" (defined as between 6 mesh and 12 mesh). In contrast, filler produced by the process of the invention contains approximately 61–64% longs and approximately 81–83% longs and mediums.

Thus a method and apparatus are provided for producing cigarette filler from cut whole leaf tobacco with a greater percentage of longs than in prior processes.

One skilled in the art will recognize that the inventive principles disclosed herein can be practiced by other than the described embodiments, which are presented for purposes of illustration and not of limitation, and the present invention is limited only by the claims which follow.

What is claimed is:

1. A method for processing whole leaf tobacco for producing cigarette filler, said method comprising the steps of:

cutting said whole leaf tobacco to substantially the same width as cigarette filler to produce strands of tobacco consisting of lamina and strands of tobacco comprising lamina and stem;

carding said cut whole leaf tobacco, without first cutting said strands to a shorter length, to disentangle said strands of cut leaf; and separating said strands comprising lamina and stem from said strands consisting of lamina.

2. The method of claim 1 wherein said strands comprising lamina and stem and strands consisting of lamina are separated pneumatically.

3. The method of claim 2 wherein said strands comprising lamina and stem and strands consisting of lamina are separated by a fluidized bed vibrating separator.

4. The method of claim 1 wherein said whole leaf tobacco is premoistened with heat and humidity prior to cutting.

5. A carding feeder for disentangling strands of cut whole leaf tobacco, comprising:

a spiked apron for lifting said strands of cut whole leaf tobacco;

a combing apron substantially parallel to said spiked apron and moving in a direction opposite to and faster than said spiked apron over their region of contact wherein said spiked apron and said combing apron maintain contact over some significant portion of the length of said spiked apron.

6. The carding feeder of claim 5 wherein said significant portion is about one-third of the length of said spiked apron.

7. The carding feeder of claim 5 wherein said combing apron moves at a velocity of from about twice to about five times the velocity of said spiked apron.

8. The carding feeder of claim 5 further comprising a stripper roller adjacent the top of said spiked apron and moving in a direction parallel to and faster than said spiked apron at their point of contact, for stripping said strands from said spiked apron and accelerating them horizontally.

9. A carding feeder for disentangling strands of cut whole leaf tobacco, comprising:

a spiked apron for lifting said strands of cut whole leaf tobacco;

a combing roller adjacent a rise of said spiked apron and moving in a direction opposite to and faster than said spiked apron at their point of contact; and an air knife for stripping said strands from said spiked apron.

10. The carding feeder of claim 9 wherein said combing roller moves at a velocity of from about twice to about five times the velocity of said spiked apron.

* * * * *

UNITED STATES PATENT AND TRADEMARK OFFICE

CERTIFICATE OF CORRECTION

PATENT NO. : 4,696,312

DATED : September 29, 1987

INVENTOR(S) : Louis R. Turano et al.

It is certified that error appears in the above-identified patent and that said Letters Patent is hereby corrected as shown below:

Cover page, in the Abstract, line 9, "may" (first occurrence) should be -- any --.

Column 2, line 17, after "is" should be inserted -- a --.

Column 4, line 34, after "at" should be inserted -- 25 --.

Signed and Sealed this

Fifteenth Day of March, 1988

*Attest:*

*Attesting Officer*

DONALD J. QUIGG

*Commissioner of Patents and Trademarks*